United States Patent [19]

Forsberg

[11] 4,230,279

[45] Oct. 28, 1980

[54] HAIR DRYER ATTACHMENT

[75] Inventor: John R. Forsberg, Arlington Heights, Ill.

[73] Assignee: Helene Curtis Industries, Inc., Chicago, Ill.

[21] Appl. No.: 46,622

[22] Filed: Jun. 8, 1979

[51] Int. Cl.[3] ..... A45D 20/12

[52] U.S. Cl. ..... 239/559; 34/97; 34/243 R; 34/96; 285/319; 285/332

[58] Field of Search ..... 219/373; 239/553.3, 239/559; 285/319, 322; 34/96, 97, 243 R

[56] References Cited

U.S. PATENT DOCUMENTS

| | | | |
|---|---|---|---|
| 610,072 | 8/1898 | Mink . | |
| 1,685,345 | 9/1928 | Voss . | |
| 1,958,007 | 5/1934 | MacDougall | 219/373 |
| 1,995,542 | 3/1935 | Haviland | 285/322 |
| 2,528,599 | 11/1950 | Loether . | |
| 2,620,893 | 12/1952 | Holt et al. | |
| 2,896,061 | 7/1959 | McMillan | 219/374 |
| 3,258,578 | 6/1966 | Ferris | 219/373 |
| 3,875,364 | 4/1975 | Boyett . | |
| 3,943,329 | 3/1976 | Hlavac | 34/96 |
| 3,955,065 | 5/1976 | Chambon . | |

FOREIGN PATENT DOCUMENTS

| | | | |
|---|---|---|---|
| 1310713 | 10/1961 | France | 285/322 |
| 1576127 | 6/1969 | France | 285/322 |

*Primary Examiner*—Larry I. Schwartz

*Attorney, Agent, or Firm*—Dressler, Goldsmith, Shore, Sutker & Milnamow, Ltd.

[57] ABSTRACT

A hair dryer attachment device for spreading and reducing the velocity of the air stream emitted from a hair dryer nozzle is disclosed. This substantially hollow device is narrower at one end than at the other end and is adapted at its narrower end for grasping a hair dryer nozzle. The wider end is fitted with a face plate containing apertures to allow an air stream to pass out of the device. The device also has a filter behind the face plate to provide resistance to the flow of air.

6 Claims, 11 Drawing Figures

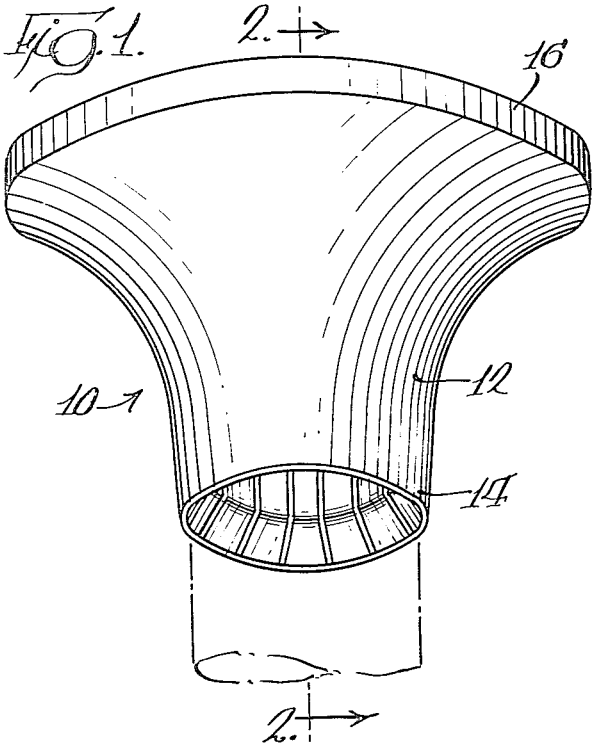
Fig. 1.
2.
16
10
12
14
2.
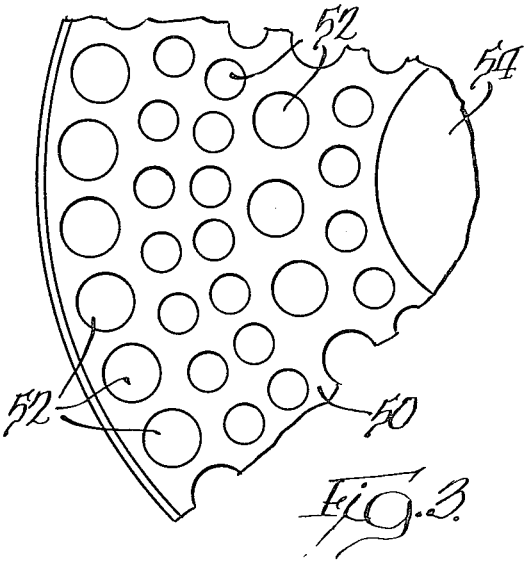
52
54
52
50
Fig. 3.
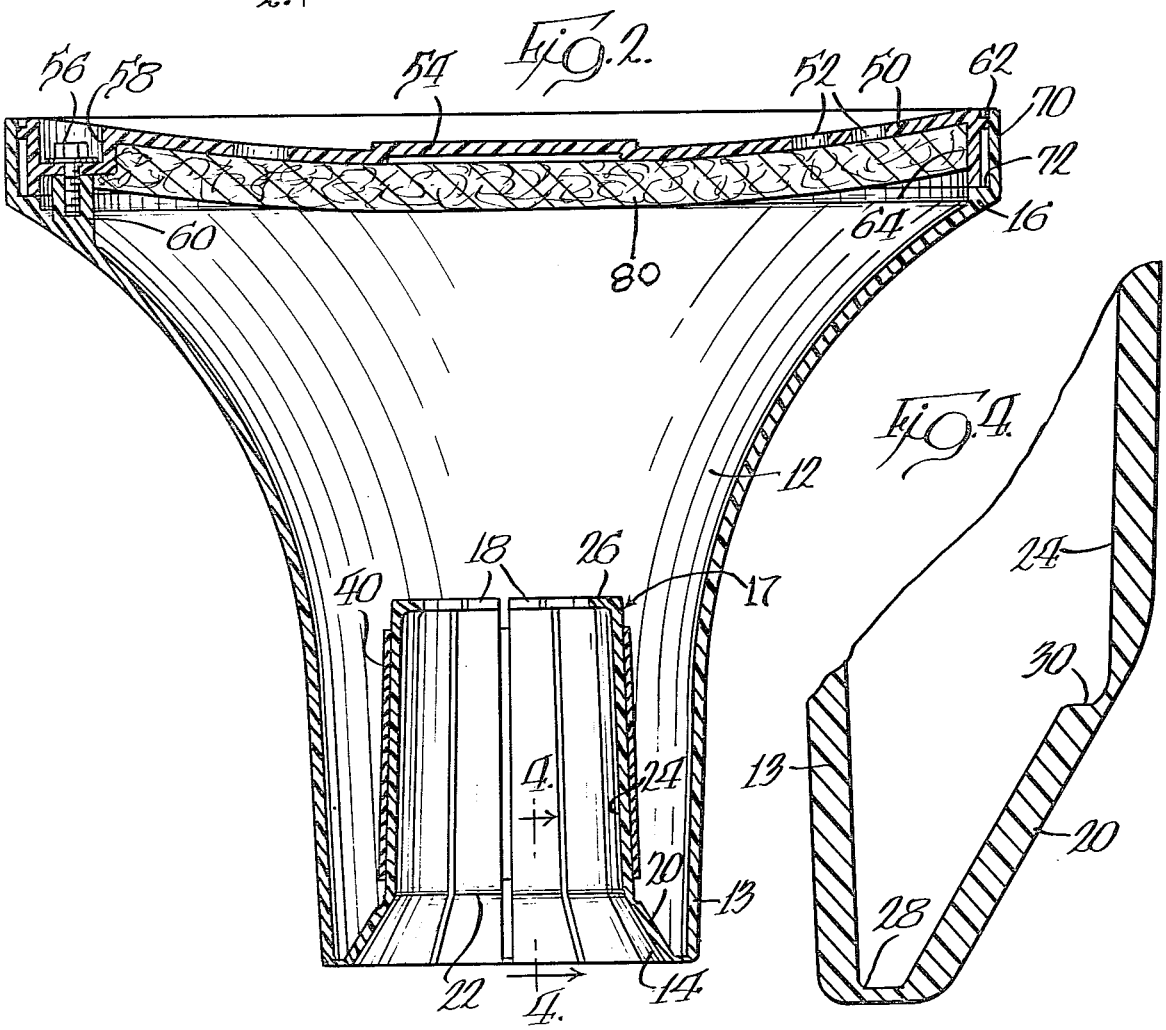
Fig. 2.
56
58
54
52
50
62
70
72
60
64
16
80
Fig. 4.
12
18
26
17
40
24
30
4.
24
13
20
20
13
28
22
4.
14

HAIR DRYER ATTACHMENT

TECHNICAL FIELD

The present invention relates to hair drying devices.

BACKGROUND ART

With the advent of modern hand held hair dryers, more and more men and women are blow-drying their hair. These modern dryers generally work by blowing a strong stream of hot air directly into and through the hair mass, rather than by circulating hot air generally around the hair. This strong stream of hot air works well for drying hair which is not set, or arranged in a final coiffure, but when the hair is set in a desired style, or is left in a curly condition, the strong air stream will frequently take out that set or curl and disarrange the carefully prepared coiffure. These results occur even though individual blow-dryers have more than one fan speed to control the rate of flow for the air stream.

DISCLOSURE OF INVENTION

This invention contemplates an attachment nozzle for a blow-dryer which will fit most pistol-shaped hair blowers, or those which have generally cylindrically shaped nozzles. Once affixed to a hair blower, the nozzle of this invention spreads the air stream and lessens the air stream velocity emitted from such a hair blower. This device comprises a generally diverging nozzle having a substantially hollow body portion open at both ends. Near the narrow, or inlet end and within the device is a means for gripping a hair dryer nozzle inserted therein. The wider, outlet end of the nozzle device is covered by a face plate having apertures to allow passage of the air stream emitted by the dryer nozzle onto the user's hair. An air flow restricting filter is placed between the nozzle's two ends to help lessen the flow and intensity of the air stream.

One advantage of using a device of this invention is that since the intensity of the blow-dryer's air stream is lessened, the chosen hair style is perturbed to a much smaller extent than if the blow-dryer were used alone, even at its lowest fan speed.

Another desirable feature of using this invention is that curlers may be taken out while the hair is still damp with little fear of losing the desired set.

Numerous other advantages and features of the present invention will become readily apparent from the following detailed description of the invention and of the described embodiments thereof, from the claims and from the accompanying drawings.

BRIEF DESCRIPTION OF THE DRAWINGS

In the accompanying drawings forming part of the specification,

FIG. 1 is a perspective view of one embodiment of the present invention;

FIG. 2 is a cross-sectional view taken along plane 2—2 of FIG. 1;

FIG. 3 is a detailed view of part of the face plate of the embodiment shown in FIG. 1;

FIG. 4 is an enlarged cross-sectional view taken along plane 4—4 of FIG. 2;

DETAILED DESCRIPTION OF INVENTION

Figure 5:
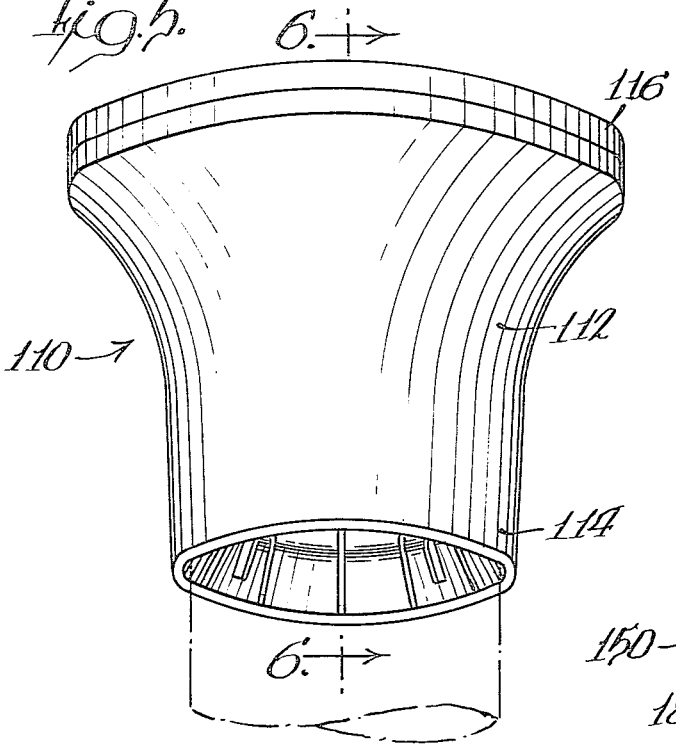
FIG. 5 is a perspective view of another embodiment of the present invention.

While this invention is susceptible of embodiment in many different forms, there are shown in the drawings and will herein be described in detail preferred embodiments of the invention. It should be understood, however, that the present disclosure is to be considered as an exemplification of the principles of the invention and is not intended to limit the invention to the embodiments illustrated.

In the following description, two digit numerals are used to refer to the embodiment illustrated in FIGS. 1-4, and three digit numerals in the one hundred series are used to refer to the embodiment illustrated in FIGS. 5-11. The same last two digits in each numeral designate similar or functionally analogous elements in the various embodiments.

One hair blower attachment device for spreading and reducing or lessening the velocity of the air stream from a hair blower or dryer nozzle of the present invention is illustrated in FIGS. 1-4 and is designated generally in FIG. 1 by numeral 10. This device 10 is comprised of a substantially hollow body portion 12 which is narrower at a first, inlet end 14 than at its second, outlet end 16, i.e., it has a generally diverging shape.

The embodiment shown in FIG. 1 has a generally circular cross-section when taken across the attachment's vertical axis, but it must be understood that the invention is not intended to be so limited.

The wide, outlet end 16 of this nozzle device is provided with a rim 70 which extends generally parallel to the vertical axis of the device. The base 72 of the rim 70 is at approximately right angles to the rim and extends inwardly. The rim 70 and its approximately perpendicular base 72 provide a seating and sealing means for the face plate 50 described hereinbelow.

A gripping means 17 for attaching the device to a hair dryer is provided within the substantially hollow body portion 12 near the narrower, inlet end 14. While several modes of attachment are possible, preferably, such attachment is effected by means of a plurality of individual flexible grasping means, or fingers, 18 which are biased inwardly to engage the blower nozzle. Although other techniques are possible, it has been found that the preferable mode of attaching the flexible fingers 18 to the body portion 12 is to mold both fingers and body in one piece. Thus, in the embodiment of this invention illustrated in FIGS. 1-4, the generally hollow body portion 12 and flexible grasping means 18 are of unitary construction with the grasping means 18 affixed to the body portion 12 only at a place near the inlet end 14.

When making the flexible nozzle grasping means or fingers 18, it is preferable to mold the individual fingers 18 at an angle oblique to the vertical axis of the device and pointing inwardly for a relatively short segment 20 of their length. After the relatively short, oblique segments 20, the fingers' shape follow generally a direction parallel to the vertical axis of the device for the remaining segments 24 of their length. The oblique segments 20 and the remaining segments 24 form a waist 22 at their conjunction.

In preferred practice, the flexible fingers 18 are generally flat and have lateral edges which generally taper or converge from the fingers' conjunction or place of affixation with the body portion 12 through their length. The end or tip portion 33 of each flexible finger 18 is provided with a lip 26 which projects inwardly. The lip 26 serves to catch the front of the dryer nozzle after the nozzle is inserted into the device to thereby limit the depth that the dryer nozzle penetrates into the device. Although the lip 26 may be set at any angle relative to the remaining segments 24, it is preferred that it be at approximately right angles thereto, or at about right angles to the vertical axis of the device when a hair dryer nozzle is inserted therein.

While the individual members 18 of gripping means 17 will flex to some degree because one end of each finger 18 is free, it has been found that the amount of flex imparted to each finger 18 may be increased by thinning each finger at the areas of greatest flexion, which have been found to occur at two places. The first such flexion area, thinned region 28, occurs between wall 13 of body portion 12 and oblique segment 20, or where the wall curves over to form each individual finger 18. The second flexion area, thinned region 30, occurs in the area where the oblique segment 20 and the generally vertical segment 24 of each finger meet. These thinned regions 28 and 30 may be easily fabricated into this hair dryer attachment device during molding and need not be added later.

As described hereinabove, the substantially hollow body portion 12 and gripping means 17 are preferably molded in one piece. The material from which the device is molded may be of any material or composite which will lend itself to injection molding; polycarbonate and polypropylene resins are preferred.

An elastomeric band 40 surrounds the gripping means 17 and serves to inwardly compress the individual fingers 18. When the dryer nozzle is inserted into the nozzle attachment of this invention, the added compression caused by the elastomeric band 40 helps keep the dryer nozzle securely within the device. When no dryer nozzle is present, the elastomeric band compresses the gripping means 17 into a cylindrical or frustoconical shape as shown in FIG. 2. The material comprising the elastomeric band 40 may be made of a number of elastomeric materials such as natural rubber, synthetic rubber, silicone rubber and the like.

A face plate 50, having a slightly dished outer surface, a detail of which is illustrated in detail in FIG. 3, closes off the second, wider outlet end 16 of nozzle device 10. The face plate 50 contains a plurality of apertures or escape holes 52 which permit escape of the air stream emitted by the dryer. The face plate holes 52 may be made in a variety of sizes and shapes. However, the center portion 54 of the face plate has no such escape holes or apertures 52 for an area at least the size of the waist 22 so that the hair dryer nozzle air stream may not escape in a straight line path from the hair dryer nozzle and through the device, but rather must first be deflected within the device before exit, thereby spreading the emitted air stream over a greater exit area. The outer surface of the center portion 54 is elevated slightly above the dished surface of plate 50 to provide a base for a label, decoration or other indicia. The face plate 50 may be fabricated from the same material as is the hollow body portion 12, or it may be fashioned from an entirely different material.

The face plate 50 may be affixed to the substantially hollow body portion 12 by several means such as by gluing, with rivets, screws and the like. A screw means 56 is used in the embodiment shown in FIG. 2. The screw means 56 is set into a recess 58 in the face plate 50, and screwed into a protrusion 60 molded into the body portion 12.

The circumferential edge 62 of the face plate 50 is slightly depressed from the outer surface of the face plate and abuts the rim 70 of the body portion 12. The inner surface of the face plate 50 is provided with a flange 64 located adjacent to the circumferential edge 62, extending toward the inside of the device and generally parallel to the vertical axis of the device. This inner flange 64 abuts the body portion base 72. Together, the circumferential edge 62, the body portion rim 70, base 72 and the inner face plate flange 64 form a seating and sealing means which prevents leakage of air around the outer edge of the face plate 50.

A filter means 80 for providing resistance to a moving air stream is affixed within the substantially hollow body 12 between the inlet end 14 and the face plate 50. This air flow restricting filter lessens the intensity of the dryer's air stream as the air leaves the device. Preferably, the air flow restricting filter 80 is placed adjacent to the inner surface of the face plate 50 and is held in place by the same screws 56 or other affixing means as hold the face plate 50 to the body portion 12.

The air flow restricting filter 80 can be made from a variety of foams, air laid non-woven structures and the like, but is preferably fabricated from a flexible polyurethane open pore foam having about 30 pores per linear inch. About a $\frac{1}{4}$ inch thickness of such a preferred foam is quite suitable.

Another way of describing the preferred filter or air restricting means 80 of the invention is by the drop in static pressure across said means when an air stream passes through it. For a device whose face plate area is about 11 square inches with an air stream of about 36 cubic feet per minute (C.F.M.) being emitted from the nozzle attachment, a static pressure drop of about 0.20 to about 0.5 inches of water is preferred when the filter is in place. Most preferred, under these conditions, is a static pressure drop of about 0.1 inches of water. Using the same face plate area of about 11 square inches, and an air stream throughput of about 50 C.F.M., the most preferred static pressure drop is about 0.2 inches of water. Again, using the same face plate area of about 11 square inches and an air throughput of about 25 C.F.M., the most preferred static pressure drop is about 0.06 inches of water.

When using a hair dryer attachment of this invention, a commercially available hair dryer or blow-dryer having a generally tubular nozzle is placed into the narrower end 14 of the device and is used as one normally would use such a blow-dryer. The flexible gripping means 17 secures the nozzle attachment of this invention to the blower and the lips 26 at the ends of the grasping fingers 18 stop the nozzle from penetrating too far into the device.

A typical, commercial blow dryer set at a fan speed setting emits an air stream of about 41 C.F.M. With the nozzle attachment of this invention 10 in place using the preferred air restricting means 80 as described hereinabove, the air stream emitted from the device is about 36 C.F.M. When using such a 36 C.F.M. throughput over a face plate area of about 11 square inches, a damp coiffure may be conveniently dried without taking out the set and with a minimal amount of disarrangement of the hair style.

FIGS. 5–11 illustrate another preferred embodiment of the instant invention which is designated generally in FIG. 5 by numeral 110. This embodiment 110 of the invention is also comprised of a substantially hollow body portion 112 open at opposite ends which is narrower at its first, inlet end 114 than at its second, wider outlet end 116, and is also generally diverging in shape. Similarly too, a cross-section taken along the vertical axis of this embodiment is generally circular.

The wide end of this dryer nozzle is provided with a rim 170 which extends generally parallel to the vertical axis of the device. The rim base 172 is at an obtuse angle to the rim 170 and is formed from the intersection of the curved inner surface of the wall 113 of the body 112 and the rim 170. The rim 170 and its base 172 provide a seating and sealing means for the base plate 150 and air resisting filter 180 described hereinbelow.

Figure 6:
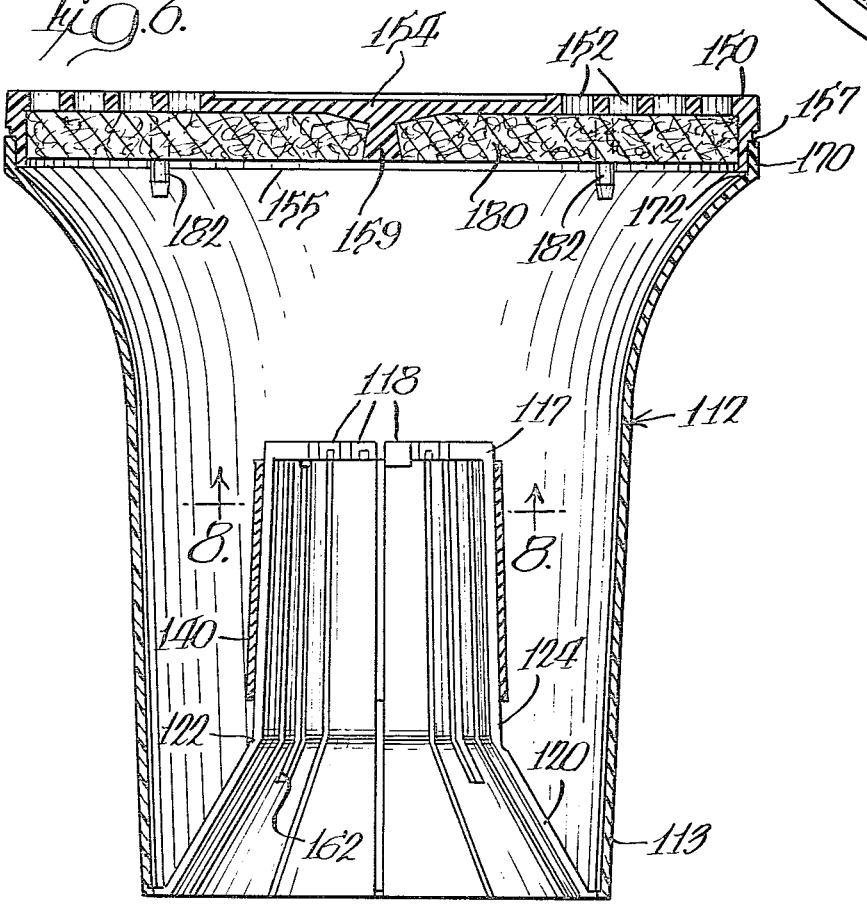
FIG. 6 is a cross-sectional view taken along plane 6—6 of FIG. 5.

A gripping means 117 for attaching the device to a hair dryer is provided within the device as described hereinabove. Attachment of this embodiment to the hair dryer is also effected by means of a plurality of individual, flexible grasping means or fingers 118, which again are biased inwardly. The gripping means fingers 118 are preferably affixed to the body portion 112 only at a place near the inlet end 114 by molding the fingers 118 and the body 112 in one piece so that body 112 and fingers 118 are of unitary construction. These fingers 118 are illustrated in FIG. 6, and portions are illustrated in detail in FIGS. 8–11.

As discussed hereinabove, it is also preferable to mold the individual fingers 118 at an oblique angle to the vertical axis of the device with the relatively short oblique segments 120 pointing inwardly and with the longer remaining segments 124 following generally in a direction parallel to the vertical axis of the device.

Flexing of the individual grasping means fingers 118 of the gripping means 117 is increased by thinning the individual fingers 118 at two regions in a fashion similar to that already discussed. The first thinned region 128 is located between the wall 113 of the body portion 112 and the oblique segment 120, and the second thinned region 130 is located at the waist 122 between the oblique segment 120 and the remaining segment 124. These two thinned regions are similar in structure to those illustrated in FIG. 4.

Figure 7:
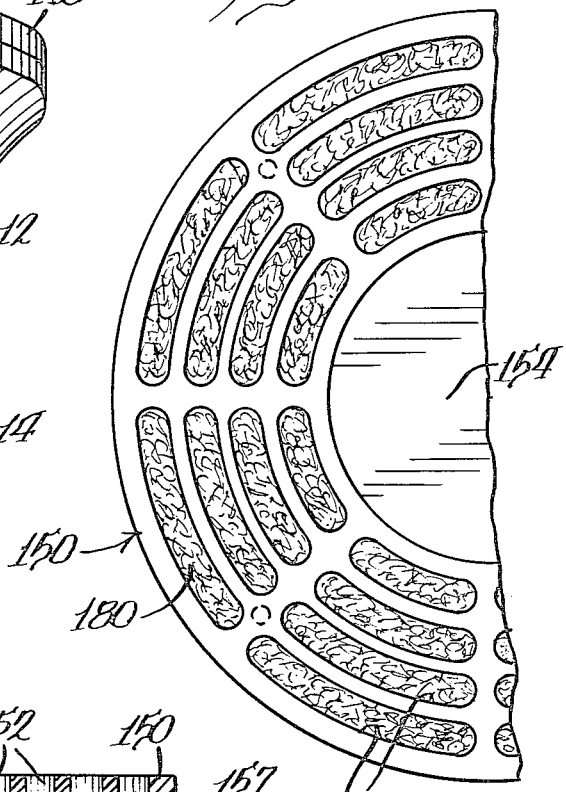
FIG. 7 is a detailed view of part of the face plate of the embodiment shown in FIG. 5.
Figure 8:
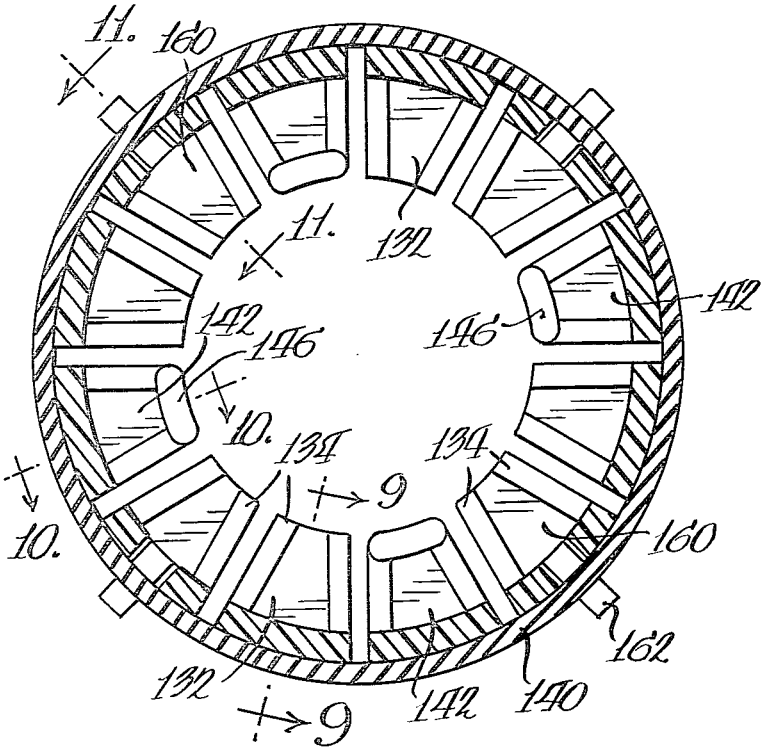
FIG. 8 is an enlarged cross-sectional view taken along plane 8—8 of FIG. 6.
Figure 11:
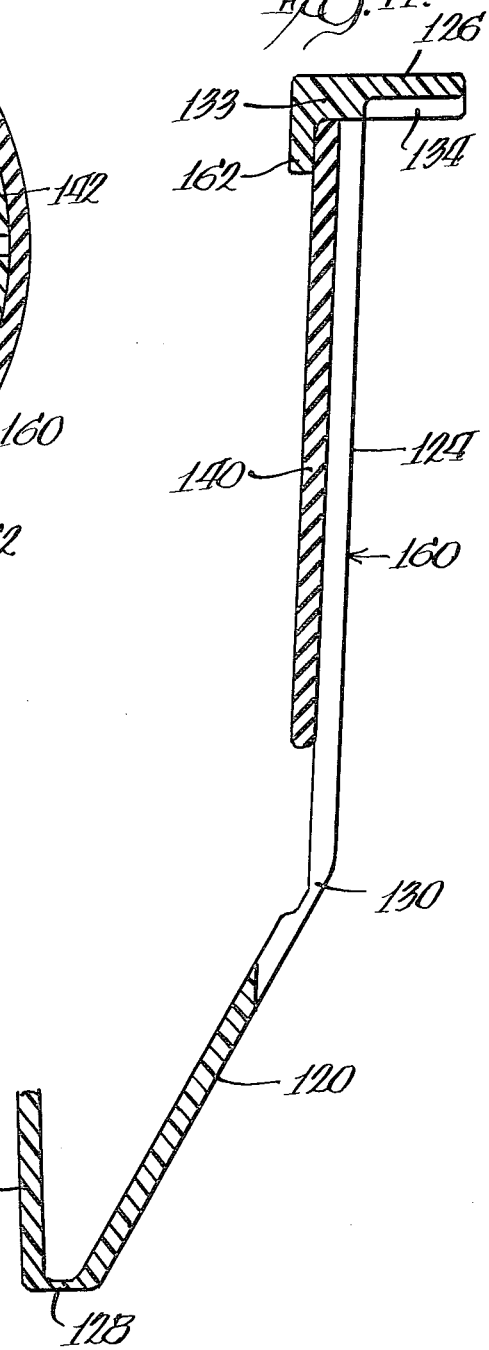
FIG. 11 is an enlarged partial cross-sectional view taken along plane 11—11 of FIG. 8.
Figure 10:
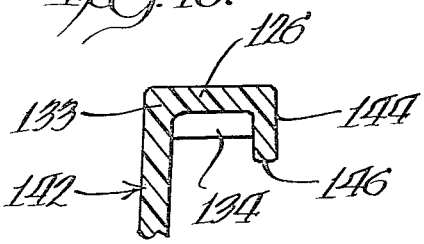
FIG. 10 is an enlarged fragmentary cross-sectional view taken along plane 10—10 of FIG. 8.
Figure 9:
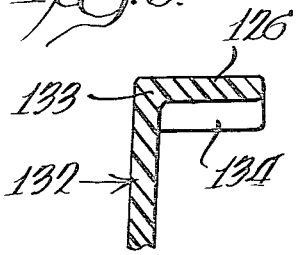
FIG. 9 is an enlarged fragmentary cross-sectional view taken along plane 9—9 of FIG. 8.

While the individual fingers 18 of the preferred embodiment illustrated in FIGS. 1–4 are substantially similar in shape, there are three differently shaped types of finger 118 in the preferred embodiment illustrated in FIGS. 5–11. FIG. 8 illustrates an arrangement of the three finger types wherein four sets of the three types are molded together to form the grasping means 117, with each finger type being repeated approximately every 90 degrees about the circumference of the gripping means.

The first finger type 132 (FIG. 9) is generally flat and its lateral edges are tapered inwardly from its short oblique segment 120 through the longer remaining segment 124 and the end or tip region 133. The tip region 133 is provided with a lip 126 which extends inwardly, at about right angles to the remaining segment 124, and serves to catch the front end of the blower or dryer nozzle after the nozzle is inserted into the device. The lip 126 thereby serves to arrest the dryer nozzle penetration into the device.

Additionally, the ends or tip regions of these fingers 132 are also provided with integrally formed walls 134 extending inwardly toward the narrow, inlet end 114 of the device, and positioned along the bottom and outer sides or lateral edges of the lip 126. These walls 134 serve to add strength to lip 126 throughout the lip's length and are present in each of the finger types of the embodiment of the invention illustrated in FIGS. 5–11.

The second finger type 142 (FIG. 10) is substantially similar to the first finger type 132 with the exception of the inwardly facing lip edge 144 of its tip region 133. Thus, the second finger type 142 is also substantially flat and tapered along its length to the tip region, has two thinned portions, and has walls 134 extending upwardly from outer sides of the lip 126.

The inwardly facing lip edge 144 of this finger type 142 additionally has an integrally formed ear 146 which extends toward the inlet end 114 of the device and which extends further than do the projecting walls 134. As a result of this further extension, the ear 146 may engage an inserted hair dryer nozzle and serve as a further means for limiting nozzle penetration into the device.

The third finger type 160 (FIG. 11) is also substantially flat and tapered along its length, has two thinned regions, and has an inwardly extending lip 126 and extending lip walls 134 in the tip region 133 similar to those of the first finger type 132. This finger type is additionally comprised of an arm 162 which extends outwardly toward the body wall 113 of the device opposite from the lip 126 and then at an approximately right angle toward the inlet end 114 to thereby form a means for engaging the elastomeric band 140 which compresses the gripping means fingers inwardly. Portions of the oblique segment 120 and the remaining segment of this finger 160 define a slot 164 which permits the removal of the integrally molded body portion 112 and gripping means 117 from the mold used in its manufacture.

The dimensions of the lip 126, extending walls 134, ear 146 and arm 162 are not critical to the invention. The dimensions should be such, however, that these structures serve their respective functions without being so large that the use of the device is impaired. For example, dimensions which have been found useful, but are not intended to be limiting include about 0.25 inches from the inner surface of the finger 118 to the inner facing lip edge 144 (lip length); about 0.06 inches for the extension of the walls 134 above the lip (wall height); about 0.12 inches for the extension of the ear 146 above the lip (ear height); about 0.07 inches for the distance along the arm 162 between the outer side of the finger 160 and the approximately right-angled portion of the arm 162; and about 0.14 inches for the inlet extending portion of the arm.

The elastomeric band 140 which compresses the fingers of the gripping means 117 into a frustoconical shape when not in use and which compressively hold the dryer nozzle within the device may be made of any suitable elastomer as already discussed. It has been found preferable to make the band of a width such that on engagement in the right-angled arm 162, the band will be in contact with more than about half of the length of the fingers 118. This contact tends to distribute the compressive forces throughout the length of the fingers' remaining segments 124 and results in a better holding of the dryer nozzle within the attachment device.

The face plate 150, shown in detail in FIG. 7, closes the second, wider outlet end 116 of the device 110 and contains four rows of concentric, arcuately shaped slots 152. The slots 152 permit escape of the hair dryer or blower air stream. As previously discussed, the center portion 154 of the face plate has no air emitting orifices in an area at least the size of the waist 122 so that the emitted air must be deflected within the device prior to exit therefrom.

An integrally molded circumferential flange 155 projects from the circumferential surface of the face plate 150 toward the interior of the device. The outer diameter of the flange 155 is proportioned so that it will fit within the rim 170 of the body portion 112. Penetrations of the flange 155 within the rim 170 may be governed by providing steps or ledges 157 in the outer flange wall of such dimension that the desired penetration will be achieved. Such ledges 157 also provide additional surface area for gluing the face plate 150 to the rim 170 and additionally assist in sealing the device from unwanted air leaks at its edges.

The face plate is also provided with a projection 159 on its inner surface near the center which serves to strengthen it and acts to limit the approach of the air restricting filter 180 to the back of the face plate.

An air restricting filter 180 is placed between the face plate 150 and the inner terminus of the gripping means 117. This filter serves to reduce the velocity of the air emitted from the device and thereby softens the air's impact on the coiffure. The various materials of construction and amount of air restriction caused by the filter 180 are discussed hereinabove. The filter 180 is supported between the face plate protrusion 159 and the rim base 142. Pins 182 set in the inner surface of the face plate 150 pass through the thickness of filter 180 and assist positioning the filter during and after fabrication of the hair dryer attachment. When the device is fabricated, the filter is "sandwiched" between the rim base 172 and the lower edge of the face plate flange 155, and is held in place by attachment of the face plate 150 to the body portion 112.

The above detailed description has been given for ease of understanding only. No unnecessary limitations are to be understood therefrom, as modifications will be obvious to those skilled in the art.

I claim:

1. A hair dryer attachment device for spreading and reducing the velocity of an air stream emitted from a hair dryer nozzle comprising a generally diverging, substantially hollow body portion leading from an open, narrower inlet end to a wider, open outlet end, means for attaching said device to a hair dryer connected to and extending inwardly from said inlet end and affixed to an area adjacent to said inlet end, said attaching means comprising a plurality of flexible fingers, said flexible fingers being biased to grasp a hair dryer nozzle and extending from said place of affixation first generally inwardly and oblique to the longitudinal axis of said device, and then extending in a direction generally parallel to said axis, and a face plate affixed to said body portion at said outlet end comprising a solid center portion and defining a plurality of air stream exit diffusing means.

2. The hair dryer attachment device of claim 1, wherein said flexible fingers are generally flat, and the lateral edges of which generally converge from said place of affixation to their ends, said ends having an inwardly extending lip.

3. A hair dryer attachment device for spreading and reducing the velocity of an air stream emitted from a hair dryer nozzle comprising a generally diverging, substantially hollow body portion open at opposite ends thereof, said opposite ends including a narrow inlet end and a wider outlet end;

means unitary with said body portion for attaching said device to a hair dryer located near said inlet end and within said generally hollow body portion comprising a plurality of flexible fingers affixed to said device only at a place near said inlet end, and extending from said place of affixation first generally inwardly and oblique to the longitudinal axis of said device, and then extending generally in a direction parallel to said axis, said flexible fingers being of thinner construction in the areas of greatest flexion and being generally flat and having lateral edges which generally converge from said place of affixation to their ends, said ends having an inwardly projecting lip, said fingers being surrounded by an elastomeric band, one portion of said plurality of fingers additionally having walls extending toward said inlet end of said device from the lateral edges of said lip, another portion of said plurality of fingers additionally having walls extending toward said inlet end of said device from the lateral edges of said lip and having an integrally formed ear at the inward facing edge of each lip, said ear extending further toward said inlet end than do said walls, and yet another portion of said plurality of fingers additionally having walls extending toward said inlet end of said device from the lateral edges of said lip and having an arm opposite from said lip extending outwardly toward said body portion, said arm thereafter extending at approximately right angles toward said inlet end to thereby form a means for retaining said elastomeric band;

a generally circular face plate affixed to said body portion at said outlet end comprising a solid center portion and defining a plurality of air stream exit apertures; and a means for providing resistance to a moving air stream located within said body portion between said hair dryer nozzle attaching means and said face plate.

4. A hair dryer attachment device for spreading and reducing the velocity of an air stream emitted from a hair dryer nozzle comprising a generally diverging, substantially hollow body portion leading from an open, narrower inlet end to a wider, open outlet end, means for attaching said device to a hair dryer connected to and extending inwardly from said inlet end and affixed to an area adjacent to said inlet end, comprising a plurality of flexible fingers, said flexible fingers being generally flat, and the lateral edges of which generally converge from said plate of affixation to their ends, said ends having an inwardly extending lip at least a portion of said lips having walls extending toward said inlet end of said device from the lateral edges thereof, a face plate affixed to said body portion at said outlet end comprising a solid center portion and defining a plurality of air stream exit diffusing means.

5. A hair dryer attachment device for spreading and reducing the velocity of an air stream emitted from a hair dryer nozzle comprising a generally diverging, substantially hollow body portion leading from an open, narrower inlet end to a wide, open outlet end, means for attaching said device to a hair dryer connected to and extending inwardly from said inlet end and affixed to an area adjacent to said inlet end, comprising a plurality of flexible fingers, said flexible fingers being generally flat, and the lateral edges of which generally converge from said place of affixation to their ends, said ends having inwardly extending lips, at least a portion of said lips having walls extending toward said inlet end of said device from the lateral edges thereof and having an integrally formed ear at the inward facing edge of each said lip, said ear extending further toward said inlet than do said walls, and a face plate affixed to said body portion at said outlet end comprising a solid center portion and defining a plurality of air stream exit diffusing means.

6. A hair dryer attachment device for spreading and reducing the velocity of an air stream emitted from a hair dryer nozzle comprising a generally diverging, substantially hollow body portion leading from an open, narrower inlet end to a wider, open outlet end, means for attaching said device to a hair dryer connected to and extending inwardly from said inlet end and affixed to an area adjacent to said inlet end, comprising a plurality of flexible fingers, said flexible fingers being generally flat, and the lateral edges of which generally converge from said place of affixation to their ends, said ends having inwardly extending lips, at least a portion of said lips having walls extending toward said inlet end of said device from the lateral edges thereof and having arms opposite from said lips extending outwardly toward said body, said arm thereafter extending at approximately right angles toward said inlet end to thereby form a means for retaining an elastomeric band, and a face plate affixed to said body portion at said outlet end comprising a solid center portion and defining a plurality of air stream exit diffusing means.

* * * * *